US005138932A

United States Patent [19]

Kita et al.

[11] Patent Number: 5,138,932

[45] Date of Patent: Aug. 18, 1992

[54] PUMP/MOTOR CONTROL MECHANISM

[75] Inventors: Yasuo Kita, Nishikyo; Ryosuke Sugahara, Nakagyo; Hiroaki Murakami, Ukyo, all of Japan

[73] Assignee: Shimadzu Corporation, Kyoto, Japan

[21] Appl. No.: 514,485

[22] Filed: Apr. 25, 1990

[30] Foreign Application Priority Data

Apr. 29, 1989 [JP] Japan ..... 1-109844

[51] Int. Cl.[5] ..... F15B 9/10; F01B 1/06

[52] U.S. Cl. ..... 91/378; 91/368; 91/497

[58] Field of Search ..... 91/362, 363 R, 368, 91/374, 376 R, 378, 497, 504, 417 R

[56] References Cited

U.S. PATENT DOCUMENTS

| | | | |
|---|---|---|---|
| 2,718,877 | 9/1955 | Rishel et al. | 91/376 X |
| 2,939,653 | 6/1960 | Rasmussen et al. | 91/363 R X |
| 3,020,890 | 2/1962 | Grad | 91/376 |
| 3,026,854 | 3/1962 | Wiedmann et al. | 91/376 X |
| 3,216,454 | 11/1965 | Richter et al. | 91/363 R X |
| 4,770,081 | 9/1988 | Kita | 91/1 |

FOREIGN PATENT DOCUMENTS

| | | | |
|---|---|---|---|
| 0812711 | 4/1959 | United Kingdom | 91/363 R |

*Primary Examiner*—Edward K. Look
*Assistant Examiner*—John Ryznic
*Attorney, Agent, or Firm*—Armstrong, Nikaido, Marmelstein, Kubovcik & Murray

[57] ABSTRACT

A pump/motor control mechanism comprising a first actuator for actuating forward a forward/backward member when a fluid pressure is introduced into a first cylinder chamber located in the forward/backward member, a second actuator for actuating backward the forward/backward member when a fluid pressure is introduced into a second cylinder chamber located in the forward/backward member at a position oppositely facing the first actuator, a spool holding hole which is provided in the forward/backward member and has an axis center parallel to the forward/backward direction, a spool which is slidable fitted in the spool holding hole and has on its outer periphery a high-pressure groove connected to a high-pressure fluid source and a low-pressure groove opened to a low-pressure zone, input means for driving forward or backward the spool, a first pressure introducing path whose one end is connected to the first cylinder chamber and whose other end is opened to an area which is on the inner periphery of the spool holding hole and connected to the high-pressure groove when the spool moves forward and to the low-pressure groove when the spool moves backward, and a second pressure introducing path whose one end is connected to the second cylinder chamber and whose other end is opened to an area which is on the inner periphery of the spool holding hole and connected to the high-pressure groove when the spool moves backward and to the low-pressure groove when the spool moves forward.

2 Claims, 4 Drawing Sheets

PUMP/MOTOR CONTROL MECHANISM

BACKGROUND OF THE INVENTION

The present invention relates to a displacement control mechanism utilized for a pump/motor which is arranged so as to change its displacement corresponding to the forward/backward displacement of a forward/backward member.

Such type of a pump/motor is shown, for example, in FIG. 5. It is a static-pressure type pump/motor proposed in U.S. Pat. No. 4,770,081 which is arranged so as to perform pump function or motor function by increasing or decreasing the volume of a space 103 for fluid inflow or outflow following the relative rotation of a first member 101 to second member 102. The volume can be changed by reciprocatively moving a forward-/backward member 104 supporting one of said members 101 and 102 in the direction perpendicular to a rotating axis center so as to adjust the eccentricity between both the members.

As an eccentricity control mechanism, provided are input means 105 (a stepping motor for converting electrical digital signals to mechanical displacement, in FIG. 5) and a servo mechanism 106 for reciprocatively moving said forward/backward member 104 in proportion to a controlled variable of the input means 105. The servo mechanism 106 comprises an actuator $\mathbf{107}_1$ ($\mathbf{107}_2$), for actuating forward (backward) the forward/backward means by introducing a fluid pressure into a cylinder chamber $\mathbf{107}la_2$ ($\mathbf{107}a_2$), an operating stick 108 which is located along said forward/backward member 104 and reciprocatively moves in the same direction as the forward/backward means 104 by receiving an operating input, rack gears 109 and 110 which are located on the oppositely faced areas of the operating stick 108 and the forward/backward member 104 respectively, a spool 111 which is located between the rack gear 109 and the rack gear 110 and movable reciprocatively in the direction parallel to said operating stick 108, an idle gear 112 which is pivotally connected to the spool 111 and engaged with said rack gears 109 and 110, and a liquid pressure circuit 113 which is allowed to change over in such a manner as to lock said actuators $\mathbf{107}_1$ and $\mathbf{107}_2$ when said spool 111 is in a neutral position and to move said actuator $\mathbf{107}_1$ ($\mathbf{107}_2$) in a direction in which said spool 111 returns back to its neutral position when said spool 111 is moved to a non-neutral position by the movement of said operating stick 108.

Also, variable volume type inclined-plate pump and the like have a similar volume control mechanism to the one described above, which are externally equipped with a servo cylinder with which an actuator installed on a forward/backward member is driven and are designed to feed back the output displacement of the forward/backward member through a link mechanism and the like to said servo cylinder.

However, where a volum control mechanism is arranged in such a manner that the output displacement of a forward/backward member is fed back through an intermediate mechanism such as rack pinion (or link) to a spool as described above, a large space becomes necessary to arrange the volume control mechanism around a pump body. This leads to a large size or increased weight pump along with an unavoidable problem such as higher cost and increased assembling mandays. Further, with respect to performance, because of a looseness or hysteresis of link mechanism and the like, stability, high-speed property and resolving power are liable to be deteriorated, causing a problem in reliability or durability.

The present invention has been developed to solve such problems. Accordingly, the object of the present invention is to eliminate all such problems by excluding mechanical intermediate mechanism.

BRIEF SUMMARY OF THE INVENTION

The present invention employs the following arrangement in order to achieve such purpose.

That is, a pump/motor volume control mechanism according to the present invention can be applied to a pump/motor which is arranged so as to change its volume corresponding to the forward/backward displacement of a forward/backward member, and is characterized in that said volume control mechanism comprises a first acutuator for actuating forward said forward-/backward member when a fluid pressure is introduced into a first cylinder chamber located in said forward-/backward member, a second actuator for actuating backward said forward/backward member when a fluid pressure is introduced into a second cylinder chamber located in said forward/backward member at a position oppositely facing the first actuator, a spool holding hole which is provided in said forward/backward member and has an axis center parallel to the forward/backward direction, a spool which is slidably fitted in the spool holding hole and has on its outer periphery a high-pressure groove connected to a high-pressure fluid source and a low-pressure groove opened to a low-pressure zone, input means for driving forward or backward the spool, a first pressure introducing path whose one end is connected to said first cylinder chamber and whose other end is opened to an area which is on the inner periphery of said spool holding hole and connected to the high-pressure groove when the spool moves forward and to the low-pressure groove when the spool moves backward, and a second pressure introducing path whose one end is connected to said second cylinder chamber and whose other end is opened to an area which is on the inner periphery of said spool holding hole and connected to the high-pressure groove when the spool moves backward and to the low-pressure groove when the spool moves forward.

When the spool moves forward, a fluid pressure is introduced into the first cylinder chamber while the second cylinder chamber is opened to the low-pressure zone, so that the forward/backward member follows the spool in such a manner as to move forward by the distance equal to the travel of the spool. On the contrary, when the spool moves backward, a fluid pressure is introduced into the second cylinder chamber while the first cylinder chamber is opened to the low-pressure zone, so that the forward/backward member follows in such a manner as to move backward by the distance equal to the travel of the spool.

Thus, according to the present invention, almost all elements of the volume control mechanism including the spool can be housed in the inside of the forward-/backward member, thereby allowing a much more simple structure than that of prior art. Additionally, with such structure, a self-feedback system can be arranged only by the relative-position relationship between the spool and the forward/backward member, thereby making it unnecessary to provide a mechanical intermediate mechanism. Accordingly, various problems which have been derived from such intermediate mechanism used for prior art can now be completely eliminated.

Also, in the pump/motor described in claim (2), when the spool moves backward, a fluid pressure is introduced into the first and the second cylinder chambers and since the pressure-receiving surface of the second cylinder chamber is larger than that of the first cylinder chamber, the forward/backward member follows the spool in such a manner as to move backward by the distance equal to the travel of the spool.

On the contrary, when the spool moves forward, a fluid pressure is introduced into the first cylinder chamber while the second cylinder chamber is opened to the low-pressure zone, so that the forward/backward member follows the spool in such a manner as to move forward by the distance equal to the travel of the spool.

The present invention can thus arrange a self-feedback system without using any intermediate mechanism, so that the present invention can eliminate problems which have been derived from such intermediate mechanism used for prior art and provide a compact and high-performance pump/motor volume control mechanism.

BRIEF DESCRIPTION OF THE DRAWING

FIG. 1 is a sectional front view, FIG. 2 is a sectional side view taken along line II—II of FIG. 1, and FIGS. 3 and 4 are typical action illustrative drawings.

Also.

DETAILED DESCRIPTION OF THE PREFERRED EMBODIMENT

With reference to drawings, an embodiment according to the present invention will be explained hereinafter.

Figure 1:
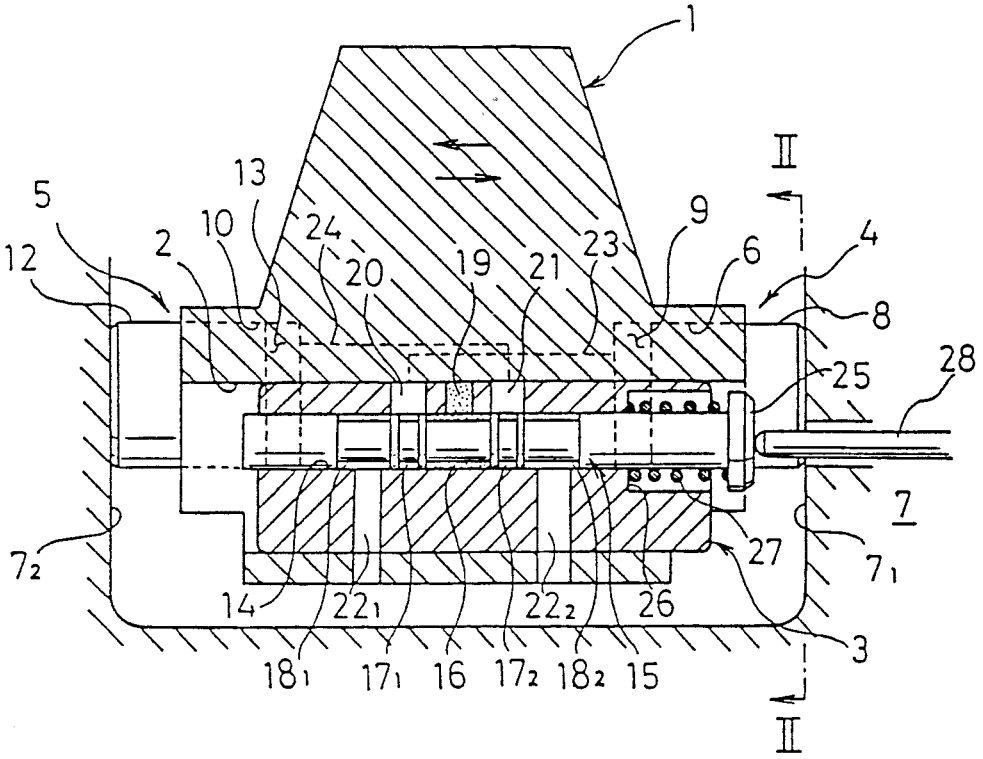
FIGS. 1 through 4 show an embodiment according to the present invention.
Figure 2:
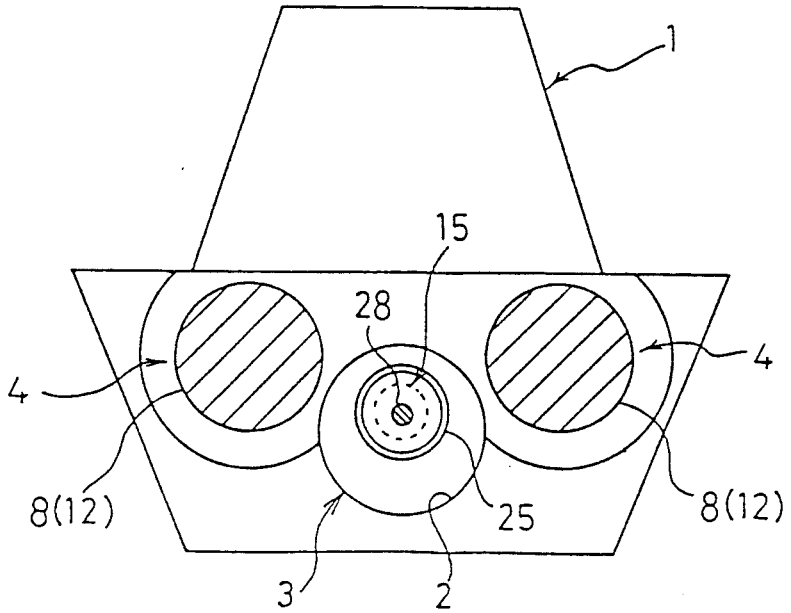
Figure 5:
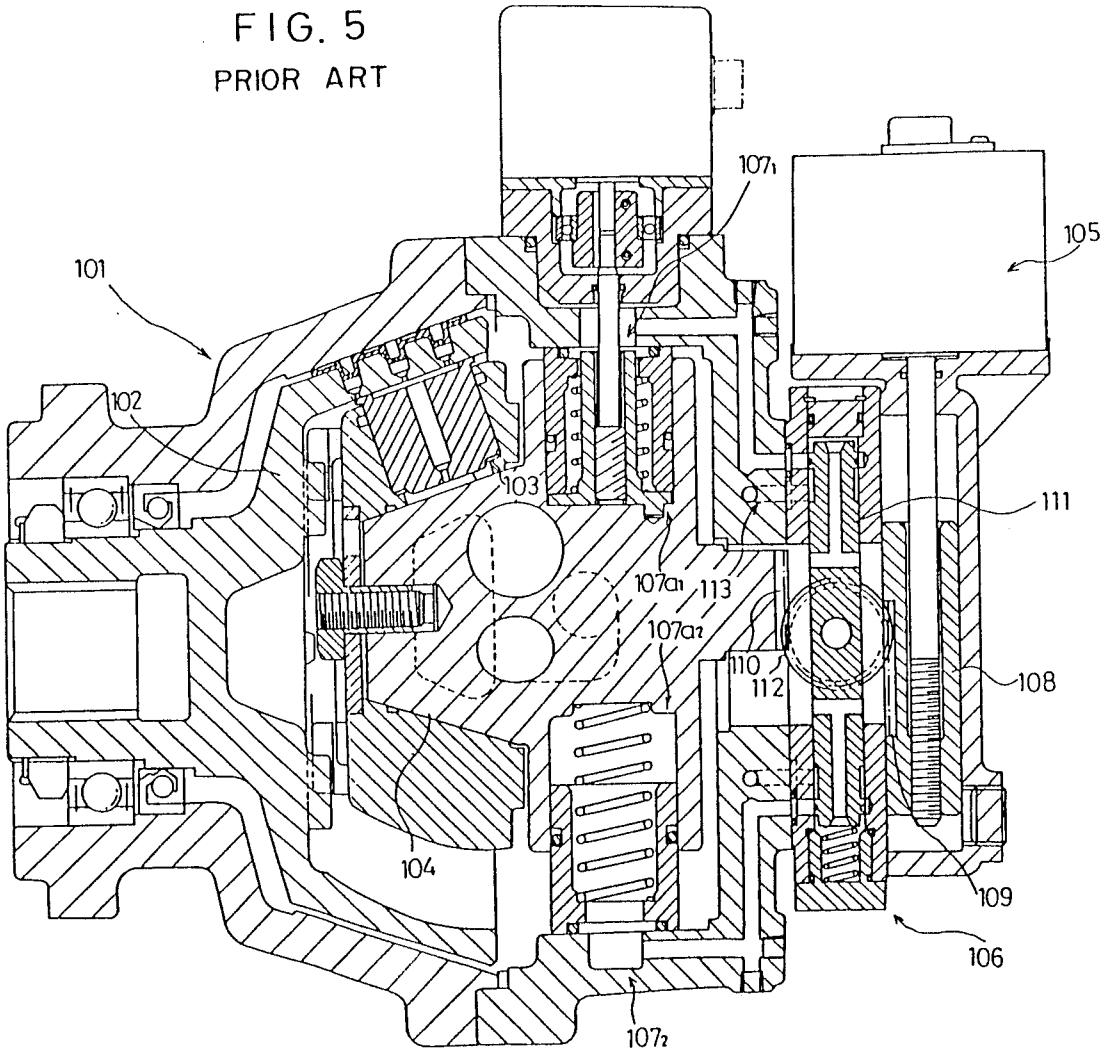
FIG. 5 PRIOR ART
FIG. 5 is a general sectional view showing a situation where a prior art example has been applied to a pump/motor.

A volume control mechanism of the embodiment which can be applied to, for example, as shown in FIG. 5 a staticpressure type pump/motor is provided with a large-diametral through hole 2 along the forward/backward direction of and in the center of a forward/backward mechanism 1, and a center block 3 made as a separate part is press fitted in said through hole 2 (FIGS. 1 and 2). First actuators 4 and 4, and second actuators 5 and 5 which have a competitively opposite relationship to each other are arranged on their respective areas displaced from the through hole 2 to its both sides. As shown in FIG. 1, the first actuator 4 is formed by concavely providing a cylinder bore 6 on the right end face of the forward/backward member 1 and by defining a first cylinder chamber 9 in such a manner that a piston 8 fixed to a housing inner-wall $7_1$ at its outer end is slidably fitted in the cylinder bore 6. The first actuator 4 plays a role to actuate forward said forward/backward member 1 leftward in FIG. 1 as viewed when a fluid pressure is introduced into the first cylinder chamber 9. As also shown in FIG. 1, the second actuator 5 is formed by concavely providing a cylinder bore 10 on the left end face of the forward/backward member 1 and by defining a second cylinder chamber 13 in such a manner that a piston 12 fixed to a housing inner-wall $7_2$ at its outer end is slidably fitted in the cylinder bore 10. The second actuator 5 plays a role to actuate backward said forward/backward member 1 rightward in FIG. 1 as viewed when a fluid pressure is introduced into the second cylinder chamber 13.

On the other hand, said center block 3 is provided with a spool holding hole 14 having an axis center parallel to the forward/backward direction and a spool 15 is slidably fitted in the spool holding hole 14. The spool 15 is provided on its outer periphery with a high-pressure groove 16 located widely on its center, intermediate grooves $17_1$ and $17_2$ located across a land on the both sides of the high-pressure groove, and low-pressure grooves $18_1$ and $18_2$ located across a land on the both ends of the intermediate grooves. On the other hand, the spool holding hole 14 in the neutral position shown in FIG. 1 is provided on its inner periphery with a high-pressure port 19 opened to said high-pressure groove 16, a first port 20 opened to said intermediate groove $17_1$, a second port 21 opened to said intermediate groove $17_2$, and drain ports $22_1$ and $22_2$ opened to said low-pressure grooves $18_1$ and $18_2$ respectively. Also, said first port 20 is connected through a first pressure introducing path 23 to said first cylinder chamber 9 in the inside of the forward/backward member 1, while said second port 21 is connected through a second pressure introducing path 24 to said second cylinder chamber 13 in the inside of the forward/backward member 1. Fluid flowing paths (not illustrated) connecting the pump/motor body to an external part are provided in pair in the inside of the forward/backward member 1, and have an unfixed pressure in terms of high or low so that the pressure may be reversed depending on service condition. Accordingly, the volume control mechanism is arranged in such a manner that said high-pressure port 19 is connected through a shuttle valve to the both fluid flowing paths so as to introduce a high-pressure from either of the fluid flowing paths at all times. The drain ports $22_1$ and $22_2$ are separately connected to a tank.

An end plate 25 is mounted on the right end of said spool 15, and a spring 27 is elastically provided between the end plate 25 and a concavely provided edge 26 of said forward/backward member 1. The spool 15 can be correctly maintained at a command position at all times in such a manner that with spring force said spool end plate 25 is allowed to be pushed on the edge of a command rod 28 being input means externally inserted through a housing 7 into the inside of said housing 7 so as to offset any gap between the spool and the rod edge.

Figure 3:
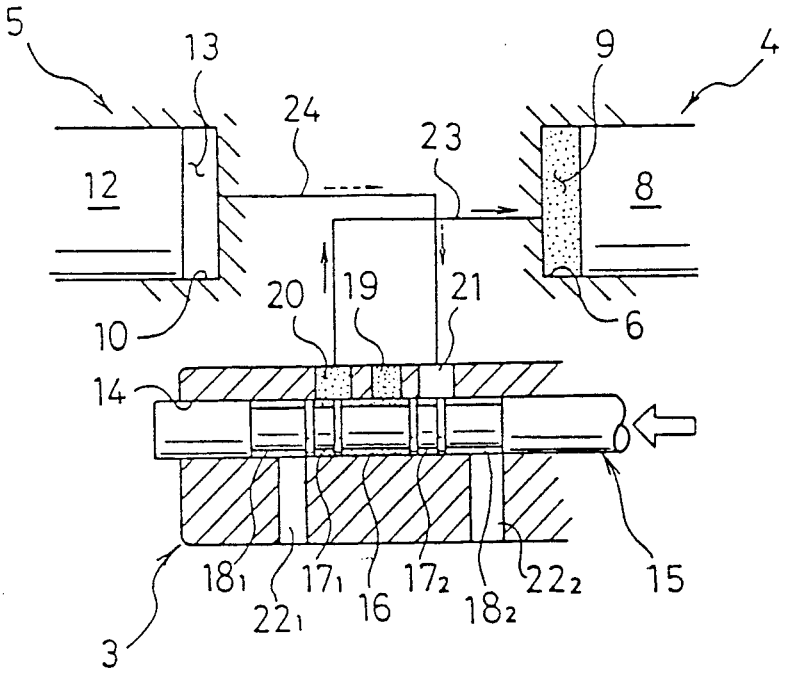
Figure 4:
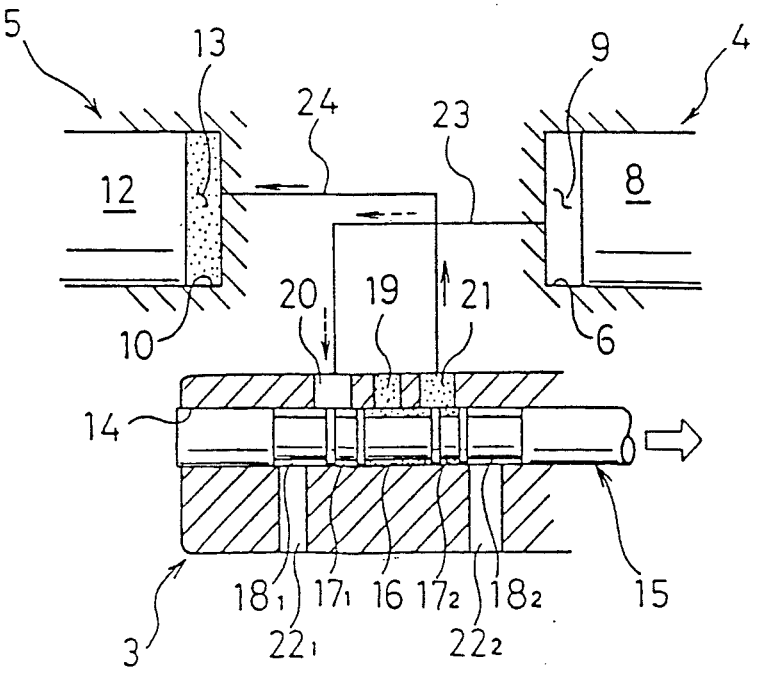

The operation of the embodiment will be explained hereinafter. When an input signal is applied through the command rod 28 to the spool 15 to be moved forward from the neutral position shown in FIG. 1, the first port 20 is connected to the high-pressure groove 16 as shown in FIG. 3, so that a fluid pressure is introduced through the first pressure introducing path 23 to the first cylinder chamber 9. On the other hand, the second port 21 is connected to the low-pressure groove $18_2$, so that the second cylinder chamber 13 is opened through the pressure introducing path 24 to a low-pressure zone. Accordingly, the forward/backward member 1 is actuated in the forward direction to follow the spool 15. When the travel becomes equal to that of the spool 15 having previously been moved, said spool 15 is reset to a relatively neutral position with respect to the forward/backward member 1, so that the operating pressure is dissipated to cause the forward/backward member 1 to be stopped. On the contrary, when the spool 15 is moved backward from the neutral position shown in FIG. 1, the second port 21 is connected to the high-pressure groove 16 as shown in FIG. 4, so that a fluid pressure is introduced through the second pressure introducing path 24 into the second cylinder chamber 13. On the other hand, the first port 20 is connected to the low-pressure groove $\mathbf{18}_1$, so that the first cylinder chamber 9 is opened through the first pressure introducing path 23 to the low-pressure zone. Accordingly, the forward/backward member 1 is actuated in the backward direction to follow the spool 15. When the travel becomes equal to that of the spool having previously been moved, said spool 15 is reset to a relatively neutral position with respect to the forward/backward member 1, so that the operating pressure is dissipated to cause the forward/backward member 1 to be stopped.

Thus, the forward/backward member 1 is displaced forward or backward correctly responding to the input signal applied to the command rod 28 to allow the pump (motor) volume to be changed. As apparent also by comparing FIG. 1 with FIG. 5, with such arrangement, almost all elements of the volume control mechanism can be housed in the inside of the forward/backward member 1. This requires a slightly increased weight and size affecting the pump/motor body and at the same time allows a decreased number of parts and cost, as well as a reduced assembling man-days. Additionally, a self-feedback system can be arranged only by the relative position relationship between the spool 15 and the forward/backward member 1, so that with respect to performance a looseness or hysteresis is eliminated, and a higher wear-resistance and a larger feedback gain are obtained. Consequently, this makes it possible to increase control speed, response characteristic and resolving power and to provide an excellent safety and durability.

Also, the forward/backward member receives a sawtooth load with an amplitude proportional to the pressure on the high-pressure side of the liquid-pressure circuit.

However, in this embodiment, the control pressure of the forward/backward member 1 is obtained from the high-pressure port 19 connected through the shuttle valve to the fluid flowing pathes, so that the forward/backward member 11 can be controlled with a control pressure corresponding to the amplitude of the sawtooth load, providing a smooth control regardless of the pressure on the high-pressure side.

Figure 6:
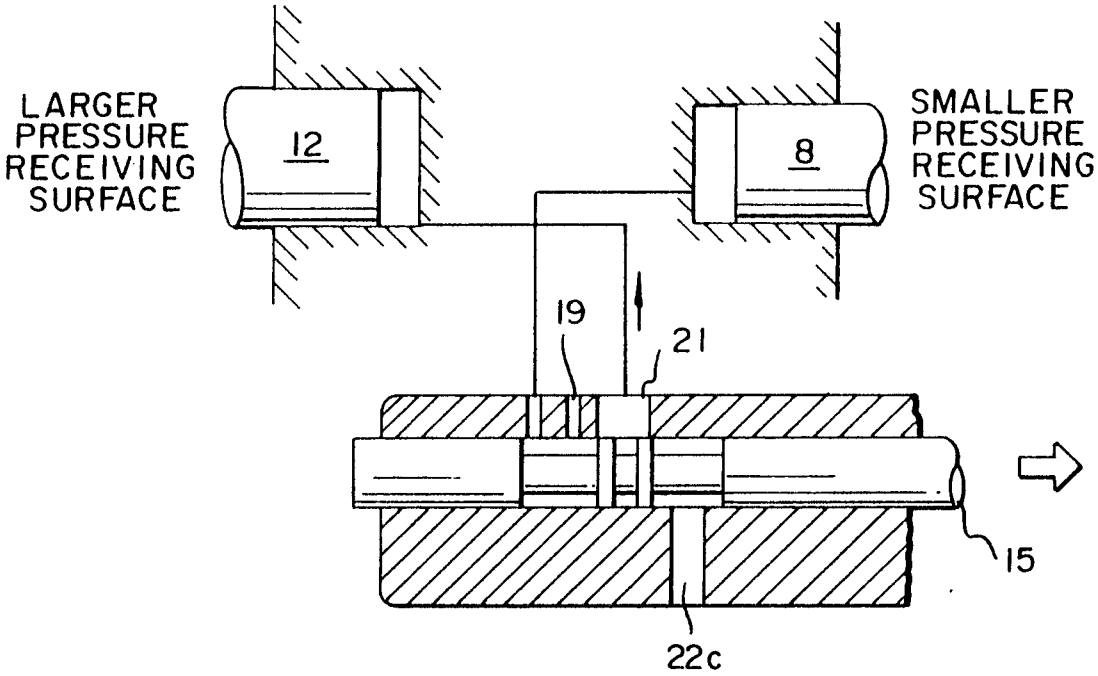
FIG. 6 is an illustrative drawing, similar to FIG. 3, of another embodiment of the invention.

Further, the spool may be allowed to penetrate directly to the outside of the housing so as to be connected to external input means. However, if the spool is arranged as shown in FIG. 1, any slight looseness in the command rod will not be transferred to the spool, providing a favorable condition for machining. FIG. 6 illustrates an embodiment of the invention which is similar to the embodiments discussed above, except where the second actuator for actuating backward the forward/backward member when a fluid pressure is introduced into the second cylinder chamber has a larger pressure-receiving surface than that of the first cylinder chamber and is located in the forward/backward member at a position oppositely facing the first actuator. Additionally, FIG. 6 illustrates a first pressure introducing path having one end which is connected to the first cylinder chamber and whose other end is opened to an area which at all times is connected to the high-pressure groove. It will be appreciated that the relationship in position between the high-pressure groove, the low-pressure groove and the pressure introducing path is not limited to the illustrated examples, and can be embodied with various modes. Additionally, although the high-pressure side of the pair of the fluid flowing paths provided in the forward/backward member is connected to the high-pressure port in the above embodiment, there is also a case where with the low-pressure side utilized an effective control can be preformed. Also, as another embodiment of the present invention, a three-way valve type servo mechanism as it is called can be practiced. In this case, such mechanism not only exhibits an effect similar to that of the first embodiment, but also has an advantage of simpler structure. Further, it will be appreciated that the volume control mechanism can be utilized for inclined-type, bent-axis type and other types of pumps/motors, and many other modifications can be made thereto without departing from the spirit of the present invention.

What is claimed is:

1. An apparatus having a pump/motor volume control mechanism which is applied to a pump/motor arranged so as to change its volume corresponding to the forward/backward displacement of a forward/backward member, said volume control mechanism comprising:

a housing supporting the pump/motor volume control mechanism;

a forward/backward member supported by said housing so as to be displaceable in both the forward and backward directions;

a first actuator for actuating forward said forward/backward member when a fluid pressure is introduced into a first cylinder chamber located in said forward/backward member, said first actuator including a first piston which is movable into abutment with said housing;

a second actuator for actuating backward said forward/backward member when a fluid pressure is introduced into a second cylinder chamber located in said forward/backward member at a position oppositely facing the first actuator, said second actuator including a second piston which is movable into abutment with said housing;

a spool holding hole disposed in said forward/backward member and having an axis center which is parallel to the forward/backward direction;

a spool which is slidably fitted in the spool holding hole and has on its outer periphery a high-pressure groove connected to a high-pressure fluid zone and a low-pressure groove opened to a low-pressure zone;

input means for driving forward or backward the spool;

a first pressure introducing path whose one end is connected to said first cylinder chamber and whose other end is opened to an area which is on the inner periphery of said spool holding hole and connected to the high-pressure groove when the spool moves forward and to the low-pressure groove when the spool moves backward; and a second pressure introducing path whose one end is connected to said second cylinder chamber and whose other end is opened to an area which is on the inner periphery of said spool holding hole and connected to the high-pressure groove when the spool is moved backward and to the low-pressure groove when the spool is moved forward.

2. An apparatus including a pump/motor volume control mechanism which is applied to a pump/motor arranged so as to change its volume corresponding to the forward/backward displacement of a forward-/backward member, said volume control mechanism comprising:

a housing supporting the pump/motor volume control mechanism;

a forward/backward member supported by said housing so as to be displaceable in both the forward and backward directions;

a first actuator for actuating forward said forward-/backward member when a fluid pressure is introduced into a first cylinder chamber located in said forward/backward member, said first actuator including a first piston which is movable into abutment with said housing;

a second actuator for actuating backward said forward/backward member when a fluid pressure is introduced into a second cylinder chamber which has a larger pressure-receiving surface than that of the first cylinder chamber and is located in said forward/backward member at a position oppositely facing the first actuator, said second actuator including a second piston which is movable into abutment with said housing;

a spool holding hole which is provided in said forward/backward member and has an axis center which is parallel to the forward/backward direction;

a spool which is slidably fitted in the spool holding hole and has on its outer periphery a high-pressure groove connected to a high-pressure fluid zone and a low-pressure groove opened to a low-pressure zone;

input means for driving forward or backward the spool;

a first pressure introducing path whose one end is connected to said first cylinder chamber and whose other end is opened to an area which at all times is connected to said high-pressure groove; and a second pressure introducing path whose one end is connected to said second cylinder chamber and whose other end is opened to an area which is on the inner periphery of said spool holding hole and connected to the high-pressure groove when the spool is moved backward and to the low-pressure groove when the spool is moved forward.

* * * * *